US011306584B2

(12) United States Patent
Al Dawood

(10) Patent No.: US 11,306,584 B2
(45) Date of Patent: Apr. 19, 2022

(54) REMOVING FLUID FROM ROCK FORMATIONS IN OIL AND GAS APPLICATIONS

(71) Applicant: Saudi Arabian Oil Company, Dhahran (SA)

(72) Inventor: Fatimah Al Dawood, Safwa (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/363,660

(22) Filed: Mar. 25, 2019

(65) Prior Publication Data

US 2020/0308965 A1 Oct. 1, 2020

(51) Int. Cl.
*E21B 49/10* (2006.01)
*E21B 49/08* (2006.01)

(52) U.S. Cl.
CPC ..... *E21B 49/10* (2013.01); *E21B 49/0875* (2020.05)

(58) Field of Classification Search
CPC ..... E21B 49/10; E21B 49/08; E21B 49/087; E21B 49/0875
See application file for complete search history.

(56) References Cited

U.S. PATENT DOCUMENTS 6,688,390 B2 5/2004 Boize et al.
6,745,835 B2 6/2004 Fields
7,021,405 B2 4/2006 Halliburton
9,057,250 B2 6/2015 Zazovsky et al.
9,752,431 B2 9/2017 Bullock et al.
9,752,432 B2 9/2017 Smiths
2003/0094040 A1 5/2003 Proett et al.
2008/0066536 A1 3/2008 Goodwin et al.
2008/0149332 A1 6/2008 Gordon et al.
2008/0156487 A1 7/2008 Zazovsky et al.
2015/0176405 A1 6/2015 Corre et al.
2018/0003049 A1* 1/2018 Gisolf ..... E21B 34/06
2018/0106148 A1 4/2018 Gisolf et al.

OTHER PUBLICATIONS

PCT International Search Report and Written Opinion in International Appln. No. PCT/US2020/024383, dated Jul. 27, 2020, 15 pages.

* cited by examiner

*Primary Examiner* — Catherine Loikith
(74) *Attorney, Agent, or Firm* — Fish & Richardson P.C.

(57) ABSTRACT

A method of removing fluid from a rock formation using a sampling tool includes deploying first and second probes of the sampling tool to first and second positions respectively along a wellbore within the rock formation. The method further includes simultaneously withdrawing fluid from the rock formation through the first and second probes during a first period of time. The method further includes disabling the second probe to prevent fluid from being withdrawn from the rock formation through the second probe after the first period of time. The method further includes withdrawing fluid from the rock formation through the first probe during a second period of time while the second probe is disabled. The method further includes disabling the first probe to prevent fluid from being withdrawn from the rock formation through the first probe and simultaneously withdrawing fluid from the rock formation through the second probe.

18 Claims, 9 Drawing Sheets

601

| | Name | Type | Pressure (out) | Temperatur... | ST liquid rate | ST oil rate | ST water rate | ST gas rate | ST GOR | ST WCUT | FL Gas rate (... | FL WCUT |
|---|---|---|---|---|---|---|---|---|---|---|---|---|
| | | | psia | degF | STB/d | STB/d | STB/d | mmscf/d | SCF/STB | % | mmcf/d | % |
| 1 | Cpl | Completion | 3457.636 | 180.0278 | 21.82027 | 17.45622 | 4.364055 | 0.006982492 | 400 | 20 | 0 | 17.29001 |
| 2 | Eqp | Generic equipment | 5611 | 364.0125 | 21.82027 | 17.45622 | 4.364055 | 0.006982492 | 400 | 20 | 0 | 17.45049 |
| 3 | J | Junction | 2228.283 | 187.4335 | 21.82027 | 17.45622 | 4.364055 | 0.006982492 | 400 | 20 | 0 | 17.15675 |
| 4 | J1 | Junction | 2219.667 | 186.8188 | 21.82027 | 17.45622 | 4.364055 | 0.006982492 | 400 | 20 | 4.70538E-08 | 17.15954 |
| 5 | Sk | Sink | 5611 | 364.0125 | 21.82027 | 17.45622 | 4.364055 | 0.006982492 | 400 | 20 | 0 | 17.45049 |
| 6 | Well | Well | 2251.441 | 187.5132 | 21.82027 | 17.45622 | 4.364055 | 0.006982492 | 400 | 20 | 0 | 17.16049 |

701

| | Name | Type | Pressure (out) | Temperatur... | ST liquid rate | ST oil rate | ST water rate | ST gas rate | ST GOR | ST WCUT | FL Gas rate (... | FL WCUT |
|---|---|---|---|---|---|---|---|---|---|---|---|---|
| | | | Psia | degF | STB/d | STB/d | STB/d | mmscf/d | SCF/STB | % | mmcf/d | % |
| 1 | Cpl | Completion | 3457741 | 180.0271 | 21.9657 | 17.03654 | 4.259135 | 0.006981462 | 400 | 20 | 0 | 17.29001 |
| 2 | Cpl | Completion | 3452.735 | 180.0271 | 21.32328 | 17.05863 | 4.264657 | 0.006823455 | 400 | 20 | 0 | 17.28981 |
| 3 | Eqp | Generic equipment | 5611 | 365.1983 | 42.61896 | 34.09517 | 8.523791 | 0.01363808 | 400 | 20 | 0 | 17.45372 |
| 4 | J | Junction | 2285.672 | 187.057 | 21.29567 | 17.03654 | 4.259135 | 0.00681462 | 400 | 20 | 0 | 17.16758 |
| 5 | J1 | Junction | 2277.664 | 186.7555 | 42.61896 | 34.09517 | 8.523791 | 0.01363808 | 400 | 20 | 0 | 17.16719 |
| 6 | Sk | Sink | 5611 | 365.1983 | 42.61896 | 34.09517 | 8.523791 | 0.01363808 | 400 | 20 | 0 | 17.45372 |
| 7 | Well | Well | 2307.747 | 187.1486 | 21.29567 | 17.03654 | 4.259135 | 0.00681462 | 400 | 20 | 0 | 17.17086 |
| 8 | Wellc | Well | 2299.796 | 187.1678 | 21.32328 | 17.05863 | 4.264657 | 0.006823455 | 400 | 20 | 0 | 17.16953 |

801

| | Name | Type | Pressure (out) | Temperatur... | ST liquid rate | ST oil rate | ST water rate | ST gas rate | ST GOR | ST WCUT | FL Gas rate (... | FL WCUT |
|---|---|---|---|---|---|---|---|---|---|---|---|---|
| | | | psia | degF | STB/d | STB/d | STB/d | mmscf/d | SCF/STB | % | mmcf/d | % |
| 1 | Eqp | Generic equipment | 5611 | 60 | 82.634 | 66.1072 | 16.5268 | 0.0264429 | 400 | 20 | 0 | 17.64831 |
| 2 | J1 | Junction | 1810.7 | 238.9516 | 82/634 | 66.1072 | 16.5268 | 0.0264429 | 400 | 20 | 7.041094E-05 | 17.64595 |
| 3 | Sk | Sink | 5611 | 60 | 82.634 | 66.1072 | 16.5268 | 0.0264429 | 400 | 20 | 0 | 17.64831 |
| 4 | Src | Source | 1632.8 | 239.1416 | 82.634 | 66.1072 | 16.5268 | 0.0264429 | 400 | 20 | 0.0001011048 | 17.81814 |

901

| | Name | Type | Pressure (out) | Temperatur... | ST liquid rate | ST oil rate | ST water rate | ST gas rate | ST GOR | ST WCUT | FL Gas rate (... | FL WCUT |
|---|---|---|---|---|---|---|---|---|---|---|---|---|
| | | | psia | degF | STB/d | STB/d | STB/d | mmscf/d | SCF/STB | % | mmcf/d | % |
| 1 | Eqp | Generic equipment | 5611 | 160 | 91.44964 | 73.15971 | 18.28993 | 0.0292639 | 400 | 20 | 0 | 17.64831 |
| 2 | J | Junction | 1688.16 | 238.724 | 41.3616 | 33.08928 | 8.27232 | 0.01323572 | 400 | 20 | 4.539824E-05 | 17.76435 |
| 3 | J1 | Junction | 1721.01 | 239.1583 | 91.44964 | 73.15971 | 18.28993 | 0.0292639 | 400 | 20 | 9.424515E-05 | 17.7309 |
| 4 | Sk | Sink | 5611 | 60 | 91.44964 | 73.15971 | 18.28993 | 0.0292639 | 400 | 20 | 0 | 17.64831 |
| 5 | Src | Source | 1532.8 | 239.1538 | 50.08804 | 40.07043 | 10.01761 | 0.01602818 | 400 | 20 | 6.128769E-05 | 17.81815 |
| 6 | Srcc | Source | 1650.8 | 238.6136 | 41.3616 | 33.08928 | 8.27232 | 0.01323572 | 400 | 20 | 4.87779E-05 | 17.80028 |

REMOVING FLUID FROM ROCK FORMATIONS IN OIL AND GAS APPLICATIONS

TECHNICAL FIELD

This disclosure relates to methods of obtaining clean formation fluid from rock formations in oil and gas applications.

BACKGROUND

Formation fluid can be sampled from a rock formation during a drilling process so that reservoir engineers can assess certain fluid properties of the formation fluid within the rock formation. During drilling of a wellbore into the rock formation with a drilling tool, drilling fluid typically invades the rock formation by penetrating pores of the rock formation along walls of the wellbore, thereby seeping into the rock formation and contaminating the formation fluid with filtrate that is carried in the drilling fluid. The contaminated formation fluid must be removed from the rock formation before the fluid properties of the pure formation fluid can be accurately assessed. Removing the contaminated formation fluid from the rock formation is very costly and requires an extended amount of production time.

SUMMARY

This disclosure relates to sampling methods by which clean formation fluid can be pumped out of a formation and sampled in less time than that required according to conventional sampling techniques. For example, a sampling tool includes multiple probes that are connected in series via respective branch lines to a main flow line at different depths, at which fluid in the formation has a given mobility. The probes can be selectively deployed to withdraw fluid from the formation.

In a first phase of a sampling method, all of the probes are deployed at the same time for a pre-determined amount of time or until clean formation fluid is detected, such that formation fluid is pumped out of the formation and through the probes into the main flow line simultaneously. In a second phase of the sampling method, only a single probe is deployed to withdraw fluid from the formation, while all of the other probes are retracted or closed internally while remaining intact with the formation. Once clean formation fluid is detected and sampled, or once a pre-determined amount of time has passed, the probe is retracted or closed internally, and a next probe is deployed, while all of the other probes remain retracted or closed internally. The process is repeated for each of the probes. Owing to the simultaneous fluid extraction at all of the probes during the first phase of the sampling method, the sampling method can be carried out in less time as compared to conventional sampling techniques in which the probes are solely deployed sequentially.

In some examples, the probes may be located at depths along the formation at which the mobility of the formation fluid is substantially similar at all of the probes, such that the probes can be mechanically equivalent. In other examples, the probes may be located at depths along the formation at which the mobility of the formation fluid is different at one or more of the probes, such that the probes are of different mechanical form to accommodate a higher flow rate of formation fluid that has a higher mobility. In such cases, the sampling tool may further include restrictions along branch lines of the probes that are accessing formation fluid of a higher mobility, in order to ensure that the flow rate through such probes does not exceed a desired maximum value or create a back pressure on the probes at low mobility points.

In one aspect, a method of removing fluid from a rock formation using a sampling tool includes deploying first and second probes of the sampling tool to first and second positions respectively along a wellbore within the rock formation; simultaneously withdrawing fluid from the rock formation through the first and second probes during a first period of time; after the first period of time, disabling the second probe to prevent fluid from being withdrawn from the rock formation through the second probe; while the second probe is disabled, withdrawing fluid from the rock formation through the first probe during a second period of time; after the second period of time, disabling the first probe to prevent fluid from being withdrawn from the rock formation through the first probe; and while the first probe is disabled, withdrawing fluid from the rock formation through the second probe during a third period of time.

Implementations may provide one or more of the following features.

In some implementations, simultaneously withdrawing fluid from the rock formation through the first and second probes includes removing contamination from the rock formation.

In some implementations, the method further includes determining, at an analyzer of the sampling tool, that the fluid withdrawn from the rock formation through the first and second probes is substantially clean after removing the contamination from the rock formation.

In some implementations, the first period of time ends upon the analyzer determining that the fluid withdrawn from the rock formation through the first and second probes is substantially clean.

In some implementations, the first period of time is a predetermined period of time at which a majority of the contamination has been removed from the rock formation through the first and second probes.

In some implementations, the second period of time ends upon the analyzer determining that the fluid withdrawn from the rock formation through the first probe is substantially clean while the second probe remains disabled.

In some implementations, the method further includes collecting a sample of the fluid in a receptacle.

In some implementations, the second period of time is a predetermined period of time at which an operation of withdrawing fluid from the rock formation through the first probe times out while the second probe remains disabled and while the fluid that has been withdrawn from the rock formation through the first probe is still determined to be contaminated at the analyzer.

In some implementations, the first position corresponds to a first depth along the wellbore, and the second position corresponds to a second depth along the wellbore that is different from the first depth.

In some implementations, a first mobility of the fluid withdrawn from the rock formation through the first probe is equal to a second mobility of the fluid withdrawn from the rock formation through the second probe.

In some implementations, the first probe and the second probe are of the same size.

In some implementations, a first mobility of the fluid withdrawn from the rock formation through the first probe is greater than a second mobility of the fluid withdrawn from the rock formation through the second probe.

In some implementations, a first size of the first probe is greater than a second size of the second probe.

In some implementations, the method further includes restricting a first flowrate of fluid flowing through the first probe while fluid is simultaneously withdrawn from the rock formation through the first and second probes.

In some implementations, the method further includes actuating a choke valve of the sampling tool.

In some implementations, simultaneously withdrawing fluid from the rock formation through the first and second probes includes simultaneously removing contamination from the rock formation through the first and second probes and withdrawing first and second clean portions of fluid from the rock formation respectively through the first and second probes at about the same time.

In some implementations, the method further includes deploying one or more additional probes of the sampling tool respectively to one or more additional positions along the wellbore, withdrawing fluid through the rock formation respectively through the one or more additional probes during the first period of time, disabling the one or more additional probes when the second probe is disabled, and serially withdrawing fluid from the rock formation through the one or more additional probes respectively during one or more additional periods of time after the third period of time has passed.

In some implementations, disabling the first and second probes includes one or both of retracting the first and second probes within a frame of the sampling tool and closing the first and second probes while the first and second probes remain in contact with the rock formation.

In some implementations, disabling the first and second probes includes retracting the first and second probes within a frame of the sampling tool or closing the first and second probes while the first and second probes remain in contact with the rock formation.

In another aspect, a sampling tool includes first and second probes, a pump in fluid communication with the first and second probes, and a control unit programmed to control the first and second probes and the pump to carry out a method of removing fluid from a rock formation. In some implementations, the method includes deploying the first and second probes to first and second positions respectively along a wellbore within the rock formation; operating the pump to simultaneously withdraw fluid from the rock formation through the first and second probes during a first period of time; after the first period of time, disabling the second probe to prevent fluid from being withdrawn from the rock formation through the second probe; while the second probe is disabled, operating the pump to withdraw fluid from the rock formation through the first probe during a second period of time; after the second period of time, disabling the first probe to prevent fluid from being withdrawn from the rock formation through the first probe; and while the first probe is disabled, operating the pump to withdraw fluid from the rock formation through the second probe during a third period of time.

The details of one or more implementations are set forth in the accompanying drawings and description. Other features, aspects, and advantages of the implementations will become apparent from the description, drawings, and claims.

DETAILED DESCRIPTION

Figure 1:
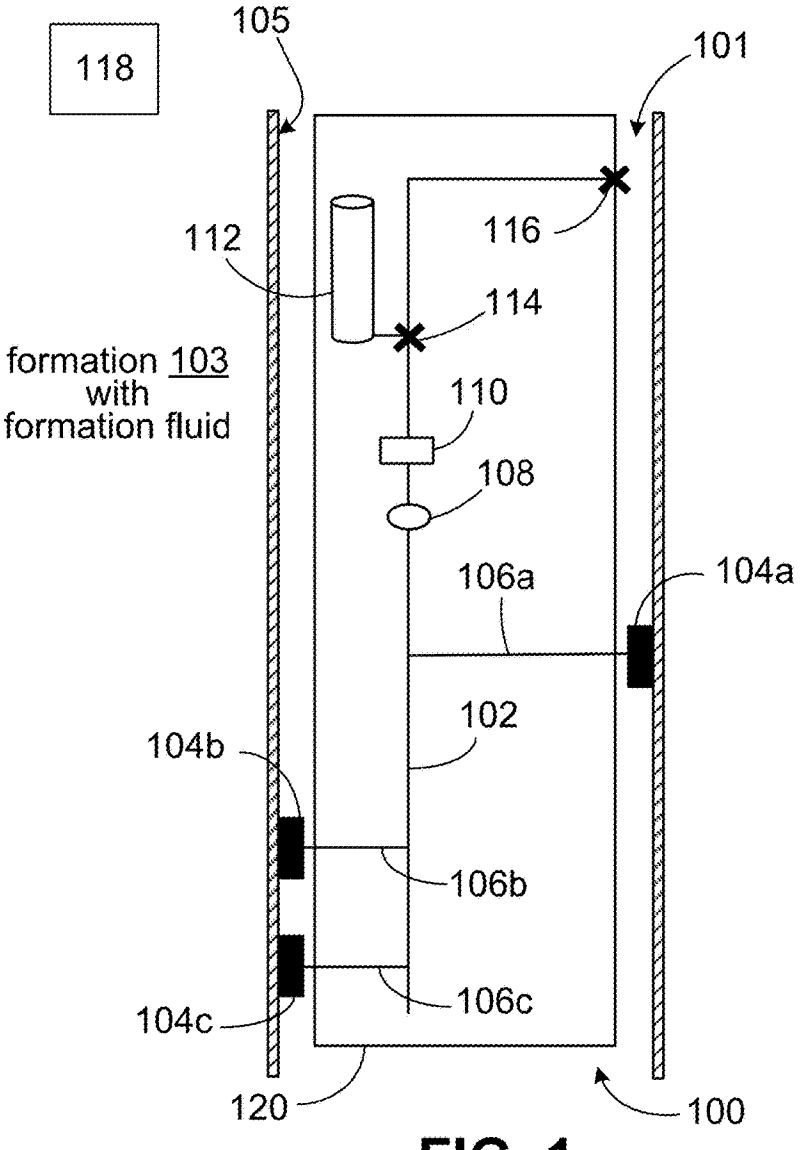
FIG. 1 is a schematic view of an example sampling tool installed in a wellbore of a formation in a first configuration, where probes of the sampling tool are mechanically equivalent.

FIG. 1 illustrates a schematic view of a sampling tool 100 installed in a wellbore 101 that has been drilled into a formation 103 (for example, a rock formation or a rock reservoir) for obtaining formation fluid from the formation 103 through walls 105 of the wellbore 101. The formation fluid is disposed within pores of the formation 103 and is sampled during a drilling process so that reservoir engineers can ascertain certain fluid properties of the formation fluid within the formation 103. During drilling of the wellbore 101 with a drilling tool, drilling fluid (for example, a water-based drilling mud or an oil-based drilling mud) typically invades the formation 103 by penetrating the pores of the formation 103 along the walls 105 of the wellbore 101, thereby seeping into the formation 103 and contaminating the formation fluid with filtrate that is carried in the drilling fluid.

In some examples, the drilling fluid may invade the formation 103 by a penetration distance from the walls 105 of the wellbore 101 during or following drilling of the wellbore 101. Though the exact penetration distance may not be determinable, the penetration distance is known to be affected by certain parameters. For example, the penetration distance of the drilling fluid can be affected by a mobility of the formation fluid, which reflects a ratio of an effective permeability of a formation to a viscosity of either formation fluid, drilling fluid, or a mixture of both formation fluid and drilling fluid (for example, contaminated formation fluid). In some examples, a penetration distance generally increases as the mobility of the formation fluid increases.

When the sampling tool 100 is operated to withdraw (for example, pump) formation fluid from the formation 103, a clean (for example, non-contaminated) reserve of the formation fluid will not be reached until a contaminated portion of the formation fluid has first been removed from the formation 103. The sampling tool 100 can be operated to obtain clean formation fluid from the formation 103 more efficiently than what can be achieved using conventional sampling techniques. The sampling tool 100 includes a main flow line 102 (for example, a pipe segment) and multiple probes 104 (for example, probes 104*a*, 104*b*, 104*c*) respectively connected in a serial arrangement to the main flow line 102 at multiple branch flow lines 106 (for example, branch flow lines 106*a*, 106*b*, 106*c*). The sampling tool 100 also includes a pump 108 that can be operated to pump formation fluid from the formation 103 and up through the main flow line 102, an analyzer 110 that can measure properties of the formation fluid, a sampling tank 112 for collecting a volume of formation fluid through a sampling valve 114, and an exit valve 116 through which the formation fluid within the sampling tool 100 is pumped out into the wellbore 101. The pump 108, the analyzer 110, the sampling tank 112, and the exit valve 116 are connected in series to the main flow line 102 above the probes 104.

The sampling tool 100 also includes a control unit 118 that can transmit signals to control operations of the various components of the sampling tool 100 and a housing frame 120 that contains the components of the sampling tool 100. The control unit 118 is located at a surface of the formation 103 and includes a receiver that receives signals and translates the signals into logs, as well as a separate panel for sending commands through voltage. Example operations that may be controlled by the control unit 118 include setting a pumping rate of the pump 108, setting a pumping strength of the pump 108 (for example, a suction generated by the pump 108), providing historical data to the analyzer 110, filling the sampling tank 112, opening and closing the valves 114, 116, deploying and retracting the probes 104, and opening and closing the probes 104.

The probes 104 can be selectively deployed (for example, extended outward from the housing frame 120 of the sampling tool to the formation 103 and opened) to allow formation fluid to be withdrawn from the formation 103 due to a pumping action of the pump 108 along the main flow line 102. The probes 104 are embodied as fluid ports that are exposed to a suction pressure generated by the pump 108 in the main flow line 102. Each probe 104 includes a circumferential rubber ring that seals the probe 104 directly to the wall 105 of the wellbore 101 and that minimizes movement of the probe 104 during pumping of the formation fluid through the probe 104. Each probe 104 also includes a pressure gauge that can measure a pressure of the formation fluid passing through the probe 104.

In some embodiments, the sampling tool 100 may also be equipped with multiple packers that facilitate fluid flow through tight regions of the formation 103 (for example, regions of very small pore size) and into the probes 104. For example, the packers may be provided as expandable rubber structures that can be placed in contact with and in fluid communication with both a probe 104 and the formation 103 and then inflated to seal the formation 103. For example, an open interval between two packers may be left exposed, where formation fluid can be sucked through the open interval, indicating that the open interval has more exposure than that of a single probe 104. Thus, the packers can expand a surface area of the formation 103 at which the open interval can apply a suction force and increase a likelihood of achieving fluid flow from the formation 103 along regions of small pore size.

In some embodiments, the sampling tool 100 may further include one or more stretchers (for example, testing segments equipped with electronics necessary for data transmission) that can be attached to the main flow line 102 to allow sampling at depths that are far apart from each other. For example, if two probes 104 are configured to communicate signals over a distance of 3 m, but sampling is desired over a distance of 6 m, then the probes 104 can be spaced at the larger distance, and a stretcher having a length of 3 m can be installed to the main flow line 102 to provide extra length along which the two probes 104 can be in electrical communication.

Initially, the formation fluid that is withdrawn from the formation 103 at a probe 104 may primarily include contamination (for example, filtrate) from the drilling fluid that invaded the formation 103. In some examples, residual drilling fluid that has adhered to surfaces of the probes 104 can contribute a minimal additional amount of contamination to the formation 103 as the probes 104 are deployed for attachment to the formation 103 and separated from the formation 103 for retraction within the housing frame 120 of the sampling tool 100. Once the filtrate has been substantially removed from the formation 103 at the depth of the probe 104, the formation fluid may be substantially clean, as determined by the analyzer 110 arranged along the main flow line 102.

In some examples, the formation fluid may be characterized as clean by the analyzer 110 once a volume of drilling fluid within the formation fluid has dropped to a level of about or less than 5% to 10% of a total volume of the formation fluid being sampled at a given time. In some examples, the analyzer 110 may distinguish clean formation fluid from contaminated formation fluid based on a salinity of the formation fluid in cases where a water-based drilling mud was used to drill the wellbore 101. A threshold for salinity by which the formation fluid is considered clean or contaminated will vary depending on geochemical and water analyses for a particular formation. In other examples, the analyzer 110 may distinguish clean formation fluid from contaminated formation fluid based on other properties (for example, a gas/oil ratio (GOR)) of the formation fluid in cases where an oil-based drilling mud was used to drill the wellbore 101. A threshold for GOR by which the formation fluid is considered clean or contaminated may be determined based on a known GOR of the formation 103. For example, drilling fluid does not contain any gasses and thus has a GOR of zero. If the GOR of the sampled formation fluid sufficiently matches the known GOR of the formation 103, then the formation fluid may be considered substantially clean. Each formation has a different known GOR, which may be updated monthly. The analyzer 110 can use both known information about the formation fluid and dynamic measurements of the fluid properties (for example, such as salinity, GOR, density, and viscosity) to determine a purity level of the formation fluid. Upon the formation fluid being determined as substantially clean, a volume of about 0.25 L to about 1 L of the clean formation fluid can then be collected in the sampling tank 112 (for example, a receptacle) over a period of about 7 minutes to 15 minutes for further analysis by the reservoir engineers.

The mobility of the formation fluid can vary along a depth of the formation 103, and the mobility at the various depths can be determined prior to sampling the formation fluid via logging and using the probes 104 to take pressure measurements of the formation fluid. For example, a probe 104 can extract a small amount of formation fluid from the formation 103, retain the formation fluid for a few minutes to acquire pressure measurements, and then generate a pressure curve that is indicative of the mobility of the formation 103 at the depth of the probe 104. Invasion of the drilling fluid into the formation 103 will generally be more extensive at regions of higher mobility than at regions of lower mobility since the drilling fluid will experience less resistance to flow at regions of higher mobility.

In some examples, the probes 104 of the sampling tool 100 are deployed at different depths along the formation 103 at which the formation fluid has about the same mobility. In some examples, the probes 104 of the sampling tool 100 are deployed at different depths along the formation 103 at which the formation fluid has substantially different mobilities. For example, two mobilities of the formation fluid at two different depths may be characterized as about the same (for example, substantially equal) when a ratio of the mobilities falls within a certain range, while the two mobilities may be characterized as substantially different (for example, substantially unequal) when the ratio of the mobilities falls outside of the range. Such a range will depend on a history of the formation and the time required to pump out the formation to reach an associated ratio. In some examples, an absolute measure of mobility in units of Darcy/Centipois may be categorized in a range of low, moderate, or high, and any mobilities falling within the same category may be considered to be about the same, while any mobilities falling within different categories may be considered to be substantially different. In some examples, the flow rate at which the pump 108 is set to operate may be selected according to an expected flow rate of the formation fluid at each of the probes 104 for a given suction pressure (for example, based on historical data associated with the mobilities near the probes 104) and based on a capacity of the pump 108.

In the example of FIG. 1, all of the probes 104 are located at depths at which the formation fluid has about the same mobility. Accordingly, all of the probes 104 can be mechanically (for example, dimensionally) equivalent, since the probes 104 will experience about the same suction pressure from the pump 108 and handle about the same flow rate of formation fluid, though the probes 104 may not all experience the same formation pressure. In a first phase of a sampling operation for the scenario provided in FIG. 1, all of the probes 104 may be deployed and operated simultaneously such that formation fluid is pumped out of the formation 103 and through the probes 104 into the main flow line 102 simultaneously.

In some examples, the probes 104 are operated until the formation fluid is determined to be clean at the analyzer 110. Since the formation fluid flowing through all of the probes 104 feeds into one main flow line 102 with a single pump 108 and a single analyzer 110, the formation fluid will not be measured as clean until clean formation fluid flows into the sampling tool 100 at all of the probes 104. In contrast, the formation fluid will be measured as contaminated for as long as the formation fluid flowing through at least one of the probes 104 is contaminated due to mixing of the formation fluid from all of the probes 104 to form a commingled flow (for example, a substantially evenly distributed mixture of the formation fluids obtained from each individual probe 104) in the main flow line 102. In some examples, about 4 h to about 20 h (for example, about 4 h to about 7 h) typically passes before clean formation fluid is measured at the analyzer 110 during the first phase of the sampling operation.

In some examples, the probes 104 are deployed and operated simultaneously only for up to a predetermined amount of time, even if clean formation fluid has not yet been detected at the analyzer 110. For example, the sampling operation may "time out" at a duration for which it is expected (for example, based on historical data) that most of the contaminated portion of the formation fluid has been removed from the formation 103 at the depths of the probes 104. The predetermined amount of time is typically set at a duration of about 7 h to about 20 h.

During the sampling operation, formation fluid within the sampling tool 100 is pumped out into the wellbore 101 through the exit valve 116. At the end of the first phase of the sampling operation during which all of the probes 104 are operated simultaneously, the formation 103 will have been substantially cleaned out (for example, for cases where clean formation fluid was detected at the analyzer 110) or at least partially cleaned out (for example, for cases where the sampling operation timed out) near locations of the probes 104.

Figure 2:
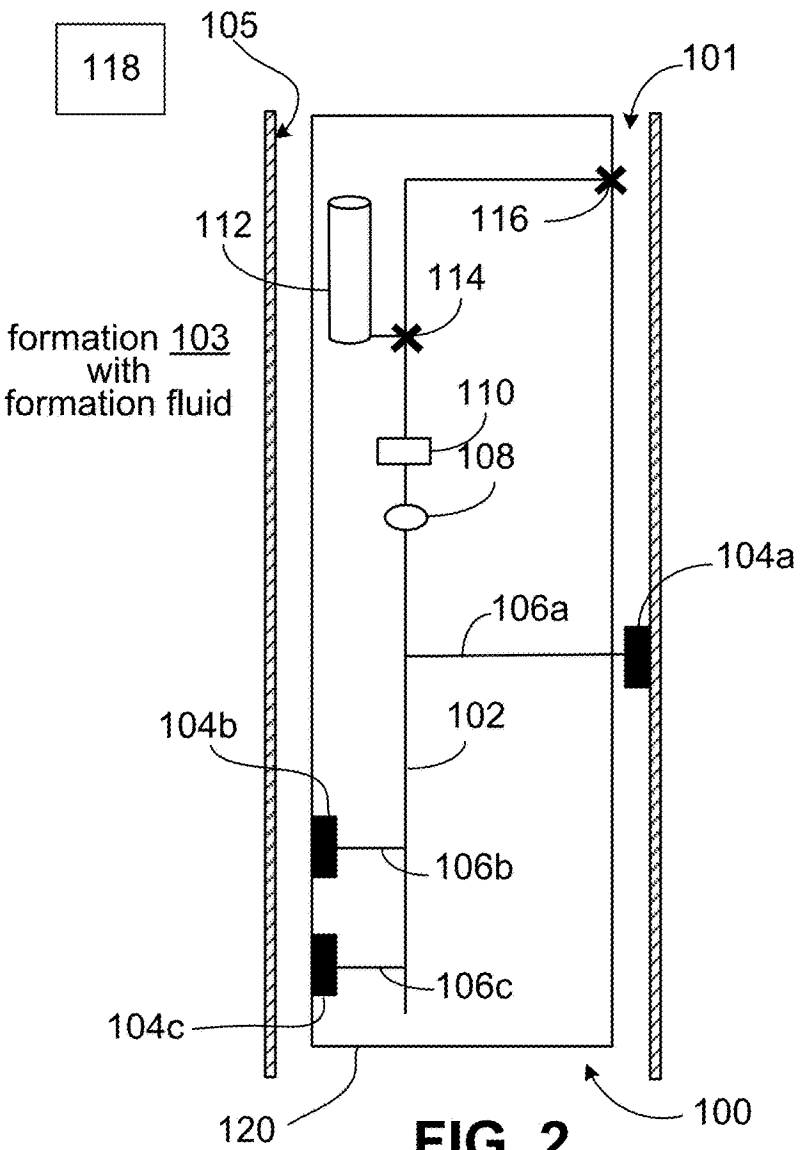
FIG. 2 is a schematic view of the example sampling tool of FIG. 1 installed in the wellbore of the formation in a second configuration.

Referring to FIG. 2, in a second phase of the same sampling operation, only a single probe 104*a* is deployed and operated to withdraw fluid from the formation 103, while all of the other probes 104*b*, 104*c* are either retracted within the housing frame 120 of the sampling tool 100 (as shown in FIG. 2) or closed internally (for example, while remaining intact with the formation 103) such that the probes 104*b*, 104*c* do not allow passage of formation fluid. In some examples, the probe 104*a* may be operated until clean formation fluid is detected at the analyzer 110. In such cases, about 0.5 h to about 1 h of additional time typically passes before clean formation fluid is detected at the analyzer 110 during a second phase of the sampling operation. Once clean formation fluid is detected, a sample of the clean formation fluid is collected in the sampling tank 112 for further analysis by the reservoir engineers, and the probe 104*a* is retracted or closed internally. In some examples, the process of pumping formation fluid out through the probe 104*a* times out and is therefore aborted at a predetermined amount of time (for example, of about 2 h to about 3 h) even though clean formation fluid has not been yet detected at the analyzer 110. For such cases, the associated portion of the formation 103 is considered non-productive due to insufficient mobility and subsequently abandoned for fluid sampling.

Once clean formation fluid has been detected at the analyzer 110 or the sampling process via the probe 104*a* has timed out, the next probe 104*b* is then deployed and operated until clean formation fluid has been detected or the process has timed out as described above with respect to the probe 104*a*, while all of the other probes 104*a*, 104*c* remain retracted (or closed internally while remaining intact with the formation 103). The probe 104*b* is then retracted or closed internally, and the process is repeated in the same manner for each remaining probe 104. That is, once clean formation fluid has been detected at the analyzer 110 or the sampling process via the probe 104*b* has timed out, the next, remaining probe 104*c* is then deployed and operated until clean formation fluid has been detected or the process has timed out, while all of the other probes 104*a*, 104*b* remain retracted or closed internally. The remaining probe 104*c* may then be retracted or closed internally, thereby effecting completion of the second phase of the sampling process.

Owing to the simultaneous fluid extraction at all of the probes 104 during the first phase of the sampling process in which the formation 103 is substantially or partially cleaned out near each individual probe 104, only a minimal amount of time is subsequently needed to obtain clean formation fluid from the formation 103 (or, for example, to determine that the sampling process should be aborted) near each individual probe 104 during the second phase of the sampling process. Thus, for a formation 103 with given properties, performing the complete process of sampling the formation 103 (for example, including both the first and second phases of a sampling operation) can be carried out in less total time as compared to the total time that would be required for conventional sampling techniques in which the probes 104 would be deployed and operated only serially, without any simultaneous operation.

Furthermore, since a goal of the formation sampling is to ascertain properties of the formation 103 at various points (for example, depths along the wellbore 101), such conventional sampling techniques would be carried out with serial operation because the sampling tool 100 includes only one main flow line 102, one pump, 108, and one analyzer 110 that cannot distinguish formation fluid obtained through any particular probe 104 from the commingled formation fluid within the main flow line 102. Therefore, sampling the exemplary formation 103 according to both the first and second phases discussed above may have a total duration of about 4.5 h to about 21 h (for example, about 4.5 h to about 8 h), whereas sampling the formation 103 according to conventional sampling techniques may require an extended period of time, such as a total duration of about 8 h to about 40 h (for example, about 14 h to about 40 h). Such reduced sampling time can advantageously lower a total cost associated with sampling the formation 103, as the cost is typically accrued per hour of fluid pumping.

Figure 3:
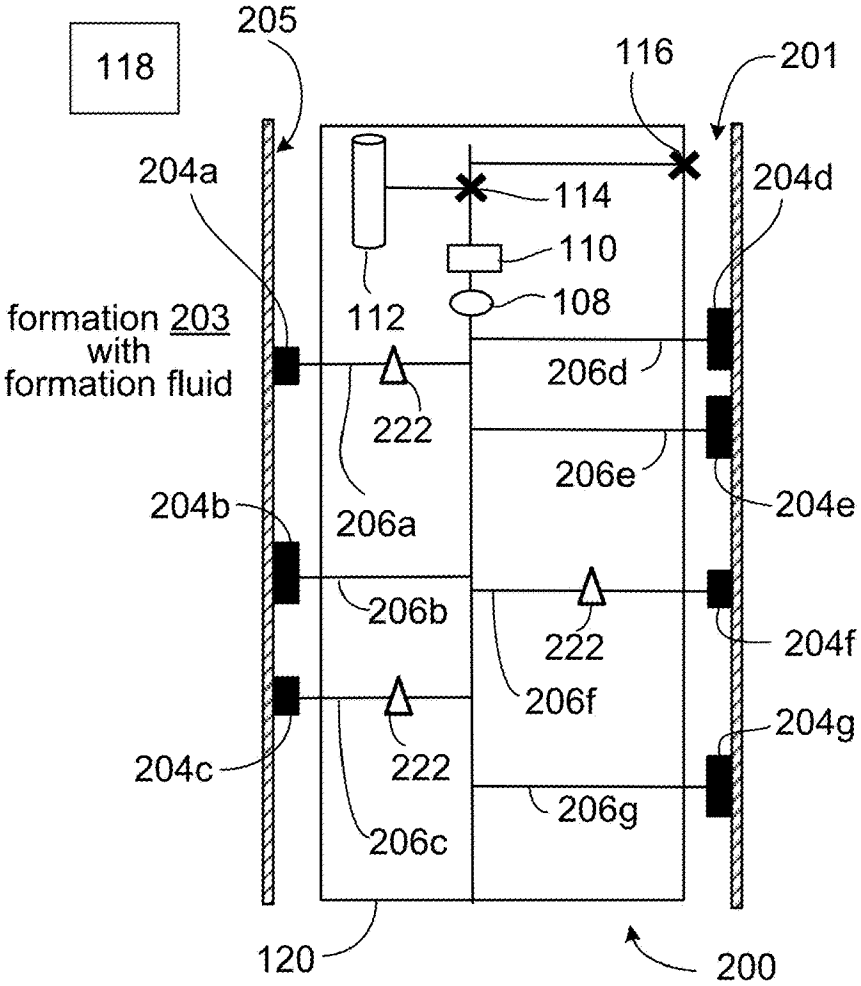
FIG. 3 is a schematic view of an example sampling tool installed in a wellbore of a formation in a first configuration, where probes of the sampling tool are mechanically different from one another.

While the sampling tool 100 has been described and illustrated as being configured to sample formation fluid at depths along the wellbore 101 for which the formation fluid has substantially the same mobility, in some embodiments, a sampling tool may be configured to sample formation fluid at depths along a wellbore for which the formation fluid has different mobilities. For example, FIG. 3 illustrates a schematic view of such a sampling tool 200 installed in a wellbore 201 that has been drilled into a formation 203 for obtaining formation fluid from the formation 203 through walls 205 of the wellbore 201.

The sampling tool 200 is similar in construction and function to the sampling tool 100, except that the sampling tool 200 includes branch flow lines 206 (e.g., branch flow lines 206*a*, 206*b*, 206*c*, 206*d*, 206*e*, 206*f*, 206*g*) and associated probes 204 (e.g., probes 204*a*, 204*b*, 204*c*, 204*d*, 204*e*, 204*f*, 204*g*) instead of the branch flow lines 106 and the probes 104. Accordingly, the sampling tool 200 further includes the main flow line 102, the pump 108, the analyzer 110, the sampling tank 112, the sampling valve 114, the exit valve 116, the control unit 118, the housing frame 120, one or more packers as necessary, and one or more stretchers as necessary. In some examples, valves or mechanical restrictions are placed on a probe to limit a flow rate through the probe. Such restrictions can be either configured at surface before running a sampling tool in a wellbore, or the sampling tool can be electronically controlled in such a way that installation of the restrictions is controlled remotely.

The probes 204 are located at depths along the formation at which the mobility of the formation fluid is different at one or more of the depths, such that one or more of the probes 204 respectively are of different mechanical form (for example, of different size, such as internal diameter or port size, which is a slotted portion of a probe 204 where formation fluid enters the probe 204) than a remainder of the probes 204 to accommodate a higher flow rate of formation fluid that has a higher mobility. For example, in the illustration of FIG. 3, the probes 204*b*, 204*d*, 204*e*, 204*g* are located at depths at which the formation fluid has substantially the same relatively low mobility, whereas the probes 204*a*, 204*c*, 204*f* are located at depths at which the formation fluid has substantially the same relatively high mobility. Accordingly, the probes 204*b*, 204*d*, 204*e*, 204*g* are of the same first mechanical form (for example, relatively large size), whereas the probes 204*a*, 204*c*, 204*f* are of the same second mechanical form (for example, relatively small size) that is different from the first mechanical form. For example, the probes 204*a*, 204*c*, 204*f* will typically have a relatively small size as compared to the probes 204*b*, 204*d*, 204*e*, 204*g*, since a relatively high mobility at the probes 204*a*, 204*c*, 204*f* will result in a higher flow rate that needs more restriction to avoid back pressure on the lower mobility probe depths. Furthermore, the sampling tool 200 includes three choke valves 222 (for example, restrictions) positioned along the branch flow lines 206*a*, 206*c*, 206*f* associated with the higher mobility points. In some alternative embodiments, restriction may be incorporated directly into a probe (for example, as a smaller port size) in place of choke valves 204 along branch lines.

The relatively high mobility at probes 204*a*, 204*c*, 204*f* permits a higher rate of formation fluid flow to into the probes 204*a*, 204*c*, 204*f* and further into the main flow line 102 respectively through the branch flow lines 206*a*, 206*c*, 206*f* such that, without actuation of the choke valves 222 (or changing the probe ports sizes), clean formation fluid would be obtained at the probes 204*a*, 204*c*, 204*f* in a shorter time period than that at which clean formation fluid would be obtained at the probes 204*b*, 204*d*, 204*e*, 204*g*. In order to ensure that clean formation fluid is obtained from all of the probes 204 at about the same time (for example, despite the differences in mobility and probe size) for carrying out a first phase of a sampling operation, the choke valves 222 can be actuated (for example, narrowed) to limit the rate of formation fluid flow through the probes 204*a*, 204*c*, 204*f* to a selected rate. In addition to ensuring (for example, or increasing the likelihood) that clean formation fluid can be obtained at all of the probes 204 at the same time, controlling the flow rate through the probes 204*a*, 204*c*, 204*f* in this manner can also ensure that the fluid flow through the probes 204*a*, 204*c*, 204*f* does not exert back pressure on the probes 204*b*, 204*d*, 204*e*, 204*g* and that the pressure in the branch flow lines 206*a*, 206*c*, 206*f* is sufficiently limited so it matches the fluid flow in the branch flow lines 206*b*, 206*d*, 206*e*, 206*g*. Therefore, back pressure is not exerted on the probes 204*b*, 204*d*, 204*e*, 204*g* located at depths of lower mobility. In other words, the choke valves 222 can be actuated to effect a pressure drop in the branch flow lines 206*a*, 206*c*, 206*f*. In some examples, if clean formation fluid is not to be obtained at all of the probes 204 at the same time, then the higher mobility points can be pumped out separately after the first phase (for example, in which the formation will be partially clean at these points).

A diameter that should be selected for a choke valve 222 (for example, the degree to which a choke valve 222 should be restricted) can be determined using simulations that predict a flow rate of the fluid after the fluid passes through the choke valve 222. A higher flow rate will exert more pressure. The equation for fluid flowing through a choke (for example, or a restriction generally) predicts the fluid flow rate after the choke valve 222:

$$p_{wh} = \frac{A_1 q_L R^{A_2}}{d^{A_3}}. \quad \text{(Eq. 1)}$$

The back pressure can be modeled using special software that calculates incremental pressure drops in the fluid while the fluid is passing through the choke valve 222 and exposed to friction. In Eq. 1, $p_{wh}$ is the pressure upstream of the choke, $A_1$ is the cross-sectional area through which fluid flows through the choke, $q_L$ is the fluid flow rate through the choke, R is the gas/liquid ratio of the fluid flowing through the choke, d is the diameter of the choke, and $A_1$, $A_2$, and $A_3$ are coefficients for normalizing the equation that can be determined from historical data. The simulations can also account for other parameters, such as elevation, friction of the material from which the restriction is made, length, and a type of fluid that is flowing.

The desired fluid flow rate in each branch flow line 206 should be based on the lowest mobility at which formation fluid is sampled, such that fluid flows through the probes 204*a*, 204*c*, 204*f* can be restricted to ensure that a clean formation fluid can be obtained at all of the probes 204 at about the same time. Even though the low mobility probes 204*b*, 204*d*, 204*e*, 204*g* (for example, without restriction) will reach clean formation fluid at a certain time, the formation 103 can still continue to be pumped out at these probes 204*b*, 204*d*, 204*e*, 204*g* until the restricted probes 204*a*, 204*c*, 204*f* reach a clean formation fluid. This is because the high mobility zones are restricted to match the low mobility zones. Even though the high mobility zones are also the zones of the formation 103 that took in more fluid and filtrate during drilling, the probes 204*a*, 204*c*, 204*f* are restricted so as not to yield a higher fluid flow rate that would exert a back pressure on the low mobility zones.

In order to reach clean formation fluid at all of the probes 204 at the same time in an example scenario for which the probes 204*a*, 204*c*, 204*f* are located at points of twice the mobility as points of the probes 204*b*, 204*d*, 204*e*, 204*g*, the fluid flow rate through the branch flow lines 206*a*, 206*c*, 206*f* should be more than that of the fluid flow rate through the branch flow lines 206*b*, 206*d*, 206*e*, 206*g* since twice or thrice as much contamination would have invaded the formation 203 at the depths of the probes 204*a*, 204*c*, 204*f*. Thus, the choke valves 222 can be configured to reduce the fluid flow rate in the branch flow lines 206*a*, 206*c*, 206*f* to a rate that does not exert a back pressure according to a simulation model or to a fluid flow rate within the branch flow lines 206*b*, 206*d*, 206*e*, 206*g*.

In a first phase of a sampling operation for the scenario provided in FIG. 3, all of the probes 204 may be deployed and operated simultaneously such that formation fluid is pumped out of the formation 203 and through the probes 204 into the main flow line 102 simultaneously. During this phase, the choke valves 222 are actuated as described above to control the fluid flow through the branch flow lines 206*a*, 206*c*, 206*f* so that clean formation fluid can be obtained at all of the probes 204.

In some examples, the probes 204 are operated until the formation fluid is determined to be clean at the analyzer 110. As discussed above with respect to the sampling tool 100, since the formation fluid flowing through all of the probes 204 feeds into one main flow line 102 with a single pump 108 and a single analyzer 110, the formation fluid will not be measured as clean until clean formation fluid flows into the sampling tool 200 at all of the probes 204. In contrast, the formation fluid will be measured as contaminated for as long as the formation fluid flowing through at least one of the probes 204 is contaminated due to mixing of the formation fluid from all of the probes 204 to form a commingled flow in the main flow line 102.

In some examples, the probes 204 are deployed and operated simultaneously only for up to a predetermined amount of time, even if clean formation fluid has not yet been detected at the analyzer 110. For example, the sampling operation may "time out" at a duration for which it is expected (for example, based on historical data) that most of the contaminated portion of the formation fluid has been removed from the formation 203 at the depths of the probes 204. The predetermined amount of time is typically set at a duration that is based on simulation and historical data.

During the sampling operation, formation fluid within the sampling tool 200 is pumped out into the wellbore 201 through the exit valve 116. At the end of the first phase of the sampling operation during which all of the probes 204 are operated simultaneously, the formation 203 will have been substantially cleaned out or at least partially cleaned out near locations of the probes 204.

Figure 4:
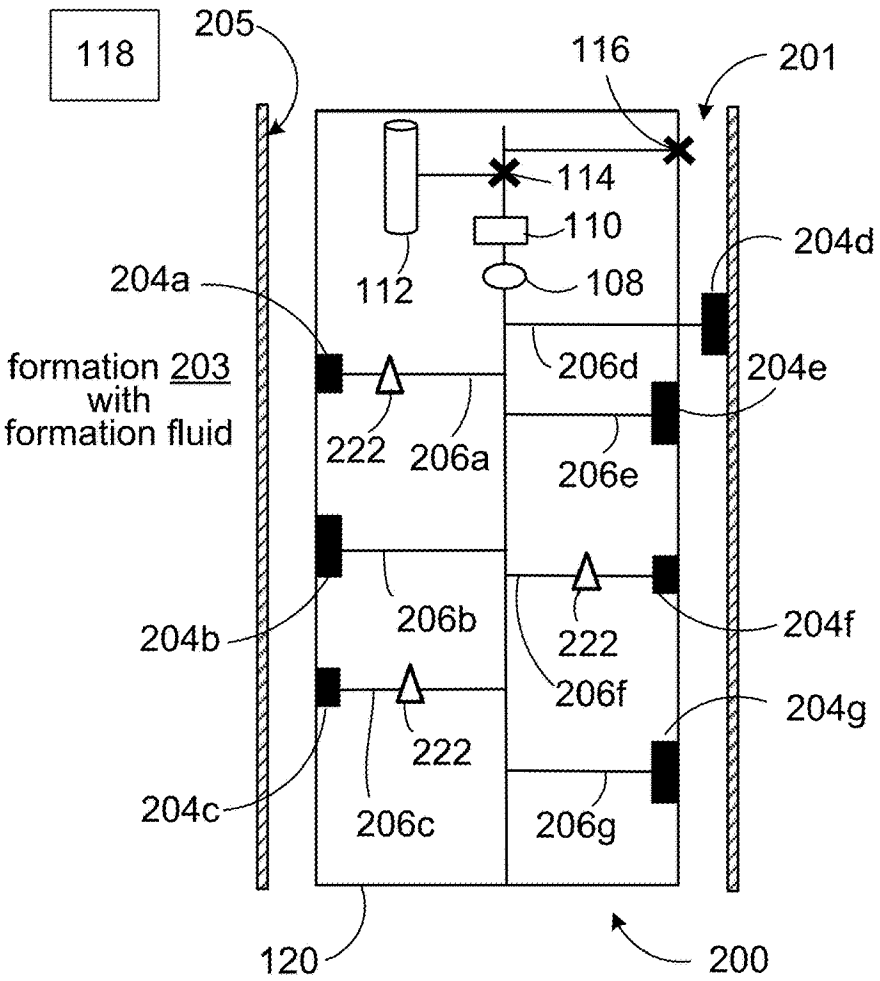
FIG. 4 is a schematic view of the example sampling tool of FIG. 3 installed in the wellbore of the formation in a second configuration.

Referring to FIG. 4, in a second phase of the same sampling operation, only a single probe 204*a* is deployed and operated to withdraw fluid from the formation 203, while all of the other probes 204*b*-204*g* are either retracted within the housing frame 120 of the sampling tool 200 (as shown in FIG. 4) or closed internally such that the probes 204*b*-204*g* do not allow passage of formation fluid. In some examples, the probe 204*a* may be operated until clean formation fluid is detected at the analyzer 110 during the second phase of the sampling operation. Once clean formation fluid is detected, a sample of the clean formation fluid is collected in the sampling tank 112 for further analysis by the reservoir engineers, and the probe 204*a* is retracted or closed internally. In some examples, the process of pumping formation fluid out through the probe 204*a* times out and is therefore aborted at a predetermined amount of time (for example, based on simulation and historical data) even though clean formation fluid has not yet been detected at the analyzer 110. For such cases, the associated portion of the formation 203 is considered non-productive due to insufficient mobility and subsequently abandoned for fluid sampling.

Once clean formation fluid has been detected at the analyzer 110 or the sampling process via the probe 204*a* has timed out, each of the remaining probes 204*b*-204*g* are then sequentially deployed and operated, one at a time, as discussed above with respect to the sampling tool 100, until clean formation fluid has been detected or the process has timed out, while all of the other probes 204 remain retracted or closed internally.

Owing to the simultaneous fluid extraction at all of the probes 204 during the first phase of the sampling process in which the formation 203 is substantially or partially cleaned out near each individual probe 204, only a minimal amount of time is subsequently needed to obtain clean formation fluid from the formation 203 (or, for example, to determine that the sampling process should be aborted) near each individual probe 204 during the second phase of the sampling process. Thus, for a formation 203 with given properties, performing the complete process of sampling the formation 203 (for example, including both the first and second phases of the sampling operation) can be carried out in less total time as compared to the total time that would be required for conventional sampling techniques in which the probes 204 would be deployed and operated only serially, without any simultaneous operation. Sampling the exemplary formation 203 according to both the first and second phases discussed above may have a total duration that can be determined based on trial tests and simulations.

Figure 5:
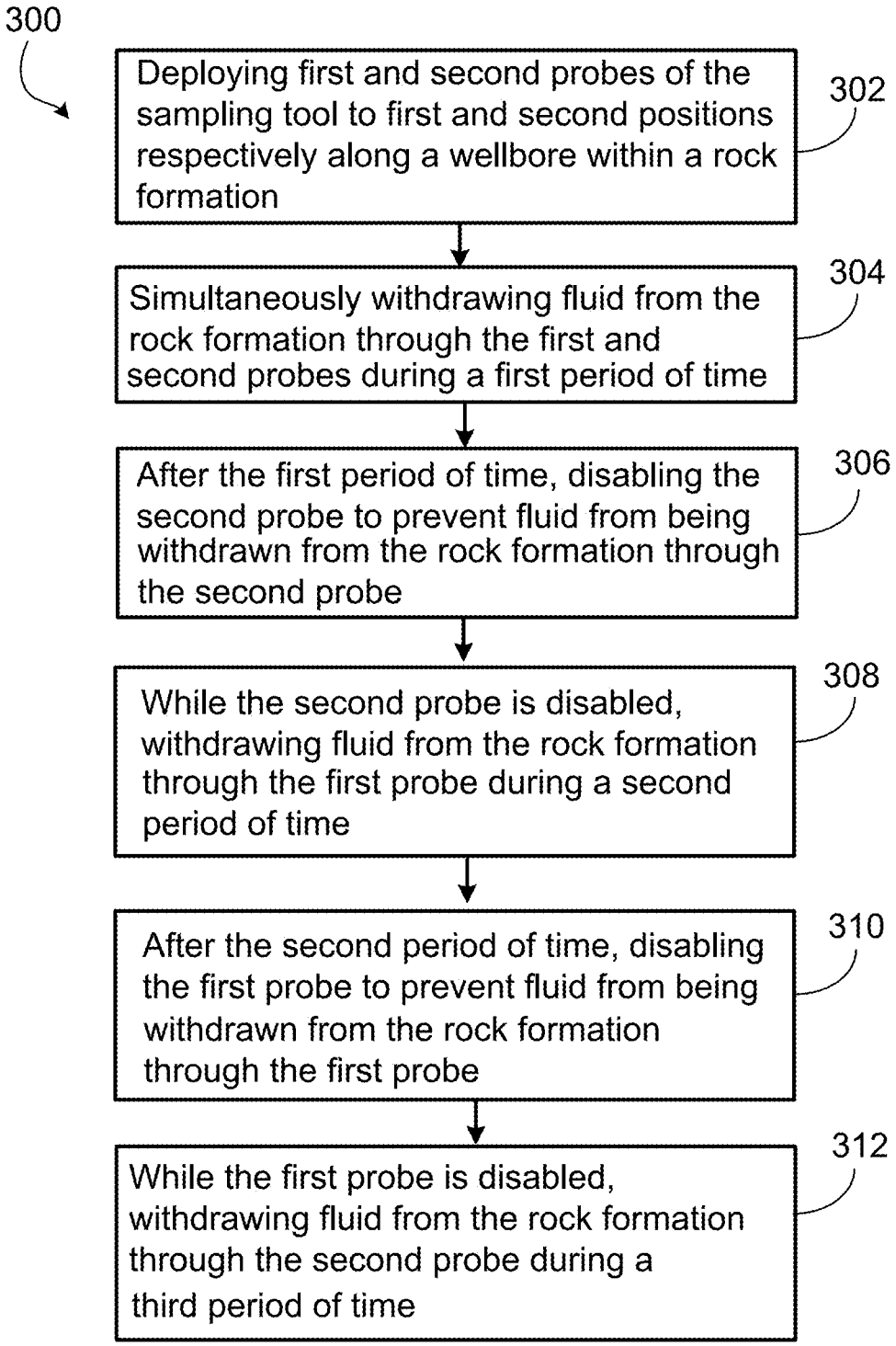
FIG. 5 is a flow chart illustrating an example method of removing fluid from a rock formation using the example sampling tool of FIG. 1 or FIG. 3.

FIG. 5 is a flow chart illustrating an example method 300 of removing fluid (for example, formation fluid) from a rock formation (for example, the formation 103, 203) using a sampling tool (for example, the sampling tool 100, 200). In some implementations, the method 300 includes deploying first and second probes (for example, the probes 104, 204) of the sampling tool to first and second positions respectively along a wellbore (for example, the wellbore 101, 201) within the rock formation (302). In some implementations, the method 300 further includes simultaneously withdrawing fluid from the rock formation through the first and second probes during a first period of time (304). In some implementations, the method 300 further includes, after the first period of time, disabling the second probe to prevent fluid from being withdrawn from the rock formation through the second probe (306). In some implementations, the method 300 further includes, while the second probe is disabled, withdrawing fluid from the rock formation through the first probe during a second period of time (308). In some implementations, the method 300 further includes, after the second period of time, disabling the first probe to prevent fluid from being withdrawn from the rock formation through the first probe (310). In some implementations, the method 300 further includes, while the first probe is disabled, withdrawing fluid from the rock formation through the second probe during a third period of time (312).

Figure 6:
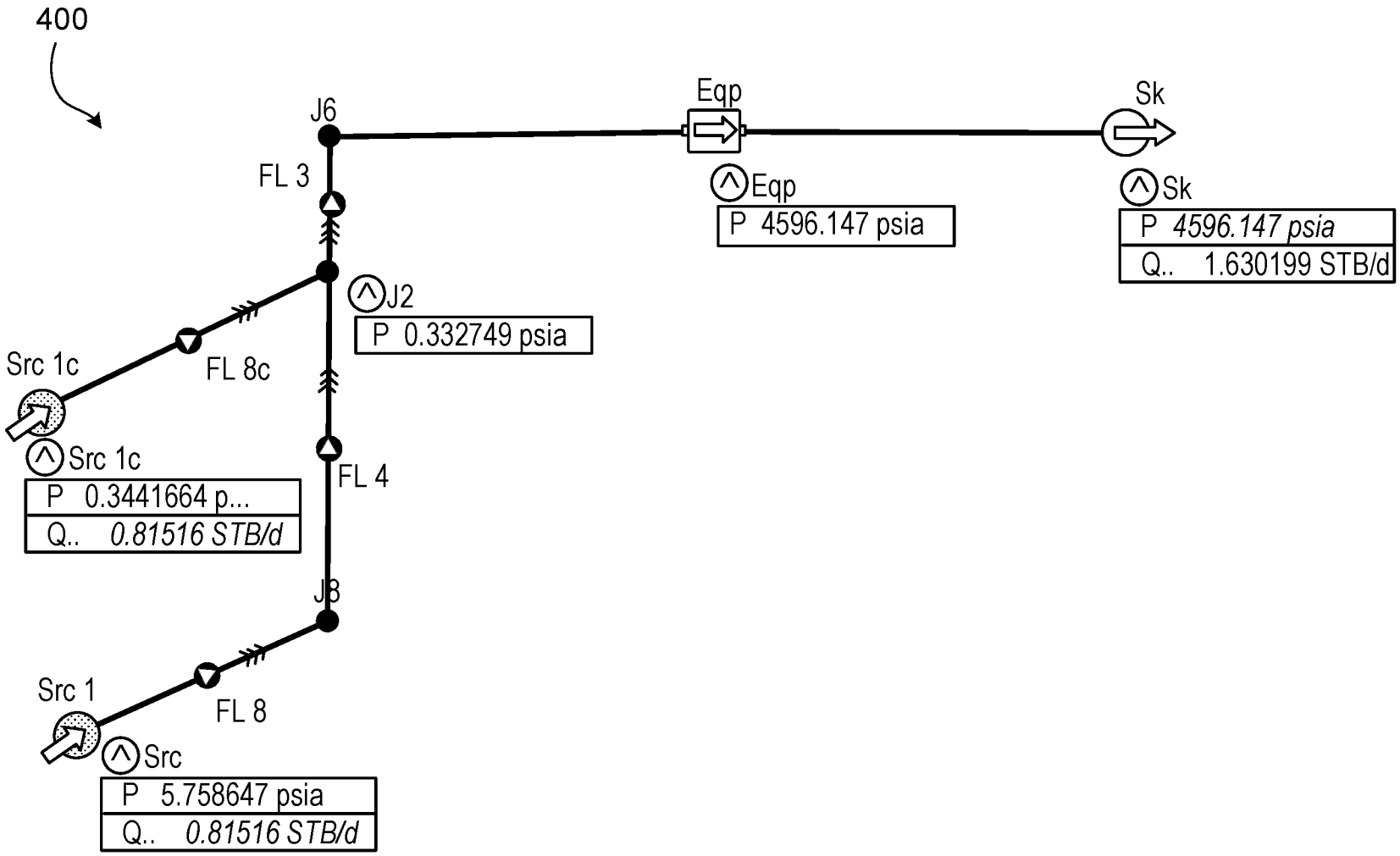
FIGS. 6-11 illustrate various simulation models and analyses for removing fluid from rock formations.

Referring to FIG. 6, a simulation model 400 (for example, a network model) has been developed using a software called PIPESIM to simulate scenarios such as those discussed above with reference to the sampling tool 100 (refer to FIGS. 1 and 2) and the sampling tool 200 (refer to FIGS. 3 and 4). Parameters what were varied in the model include an overbalance pressure resulting from drilling fluid filling up a wellbore to prevent the wellbore from flowing while drilling and a temperature of the fluid downhole. To overcome slight changes in conditions, a pump (Eqp in the model 400) was connected to a sink pressure (Sk in the model 400) that represents the overbalance pressure in the wellbore. Although the term sink often refers to a relatively lower pressure, the sink is used here as an overbalance pressure (for example, the sink pressure will have a higher pressure than the formation pressure read at each probe). The two probes are sources (Src1 and Src1*c* in the model 400) and will have lower pressure than the sink pressure. Therefore, the pump is needed to withdraw the fluid and overcome the higher pressure at the sink (for example, due to hydrostatic pressure of the drilling fluid inside the wellbore).

Starting with Src1 and Src1*c*, the simulation can occur in two ways. The first one is to specify flowrates on the sources (for example, which is what was simulated since no history information is needed). The flowrates are determined based on actual readings (for example, as discussed above with respect to the sampling tool 100, where each probe 104 will be tested for its maximum flow rate, followed by opening of the two probes 104 together to provide a commingled flow). During an operation, the flowrate is obtained by pumping out from one probe 104 singularly and then pumping out from a second probe singularly. These readings are taken and inputted into the model. Once it necessary to examine a commingled flow, the software simulates the total flowrate that comes from the two probes and whether or not that flowrate will be less than the summation of both flowrates if the singular readings were added together. At each source, formation pressure and flowrate can be inputted. Another way is to input historical data of pressure and flowrates in each source and examine to what extent the source will flow. In this example, the two branch lines are connected to the main line all the way to the pump. The pump differential pressure is entered. Following the pump, the sink is equal to the hydrostatic pressure (for example, pressure from the drilling fluid column). The modeling can be performed both the sampling tool 100 and the sampling tool 200. With respect to the sampling tool 200, the source flowrate should not be entered, but rather anticipated by the history of the formation. The history of the formation can provide an estimate of the flowrate expected such that chokes can be placed to limit the flowrates coming from respective probes.

Figure 7:
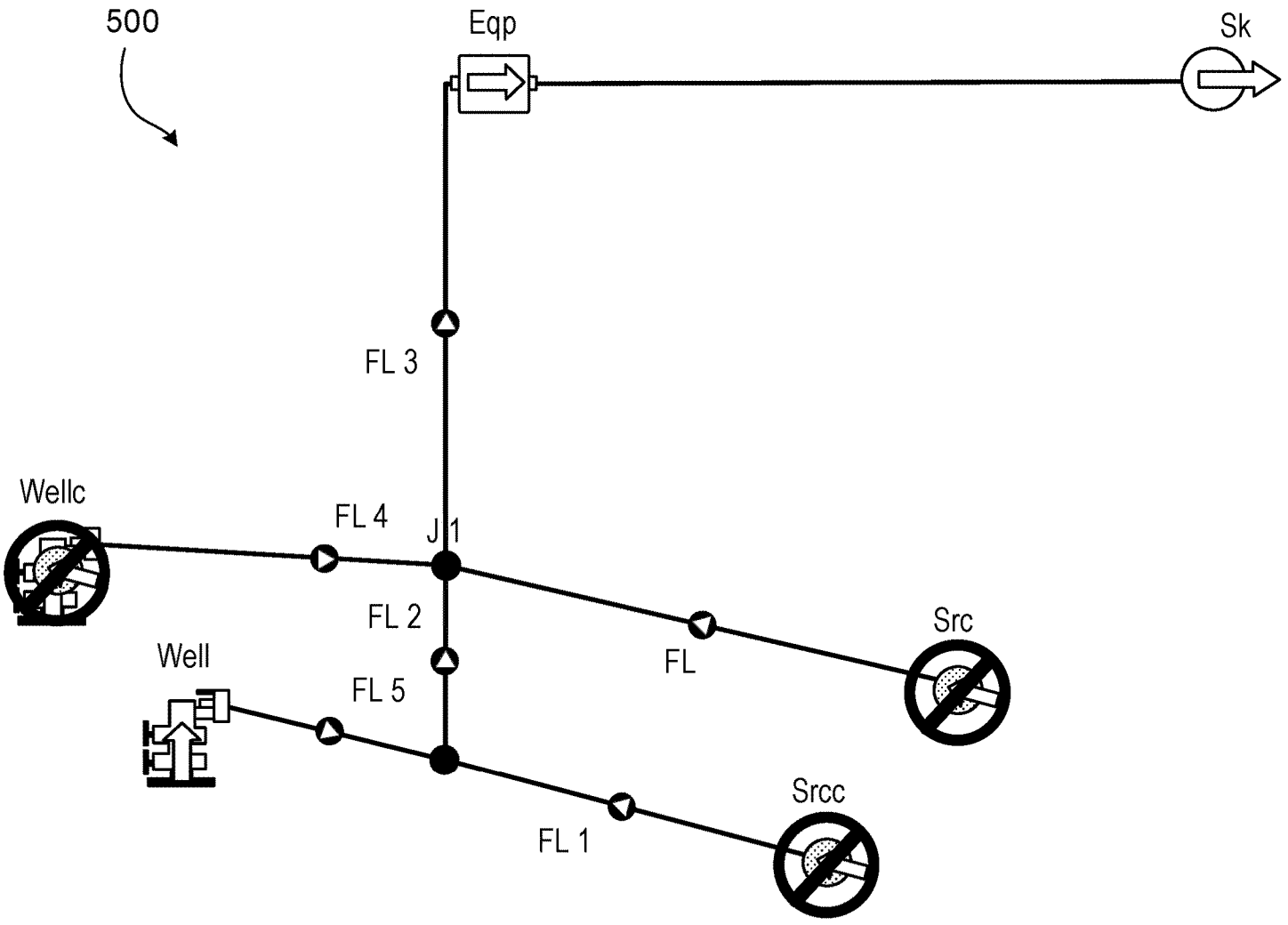

Referring to FIG. 7, a simulation model 500 (for example, a network model) has been developed using PIPESIM to simulate scenarios such as those discussed above with reference to the sampling tool 100 (refer to FIGS. 1 and 2) and the sampling tool 200 (refer to FIGS. 3 and 4). In some examples, two scenarios may be examined by running the model 500. In one scenario, simulation may be carried out using a drawdown pressure obtained at each probe from the trial test carried out using the simulation model 400 of FIG. 6. In another scenario, a productivity index (PI) is assumed at each probe (corresponding to Well and Wellc in the model 500).

Given that the differential pressure of the pump is 3416 psi, the model 500 can have high flow rates up to 160 cubic centimeters (cc). However, the actual scenario would be assigning productivity indexes that correspond to formation mobilities. Simulation with PI indexes gives a lower flow rate. The scenarios discussed above with respect to the sampling tools 100, 200 were proven when assigning PIs to the probes. When each of the two probes is flowed by itself, it yields a rate that is half the total rate obtained when the two probes are flowed together. This confirms that the flowrate increases when more than one probe is flowed, given that the total flowrate does not exceed the capacity of the flowlines and the capacity of the pump that is determined by its differential pressure.

The following assumptions are estimates to actual tools. The sink denotes a pressure that corresponds to the overbalance pressure exerted by the mud hydrostatic head in the wellbore. Wellbore are kept overbalanced to offset high formation pressure and uncontrolled flow from reservoirs. This overbalance pressure results from the drilling mud. In this simulation, the overbalance pressure was assumed to be 5,611 psi. Regarding the pump, the differential pressure of the pump is assumed to be 3,416 psi. The differential pressure is the pressure difference between the inlet and outlet of the pump. Regarding the flowlines, the diameters of the flowlines were assumed to range from 4 mm to 5 mm. In summary, the results indicate that more flowrate is obtained when flowing from more than one probe such that the formation cleaned in a shorter amount of time. Such applications may result in large cost savings to drilling and logging operations.

Figure 8:
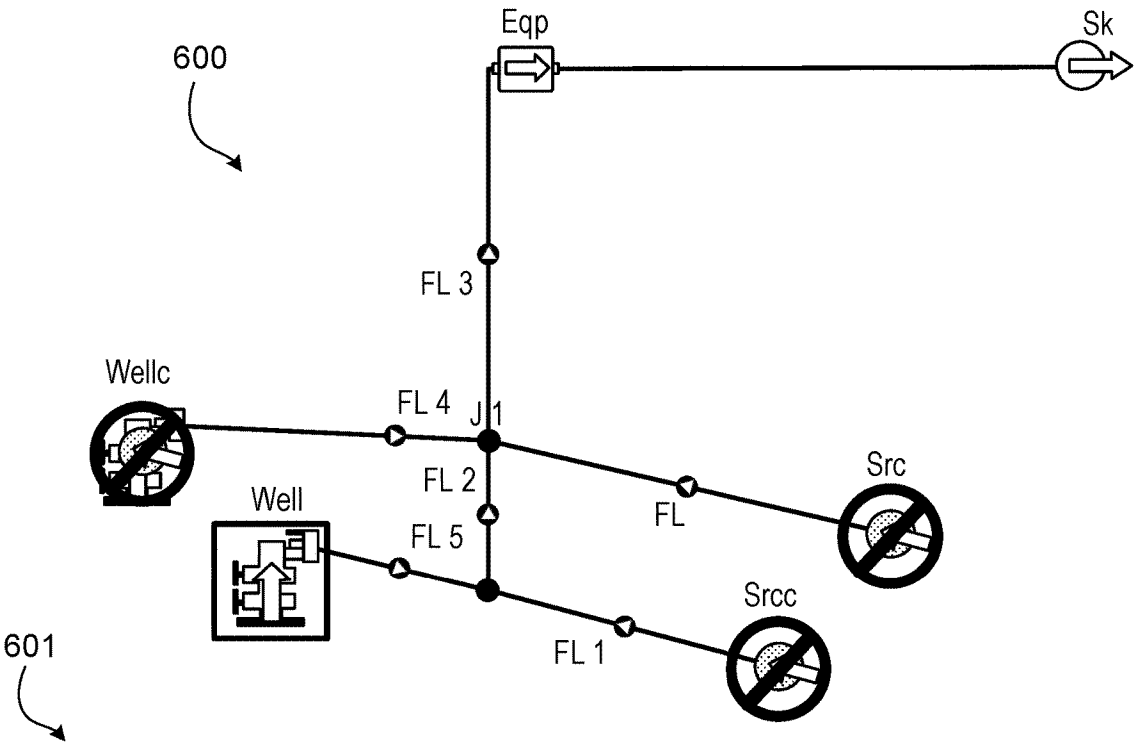
Figure 9:
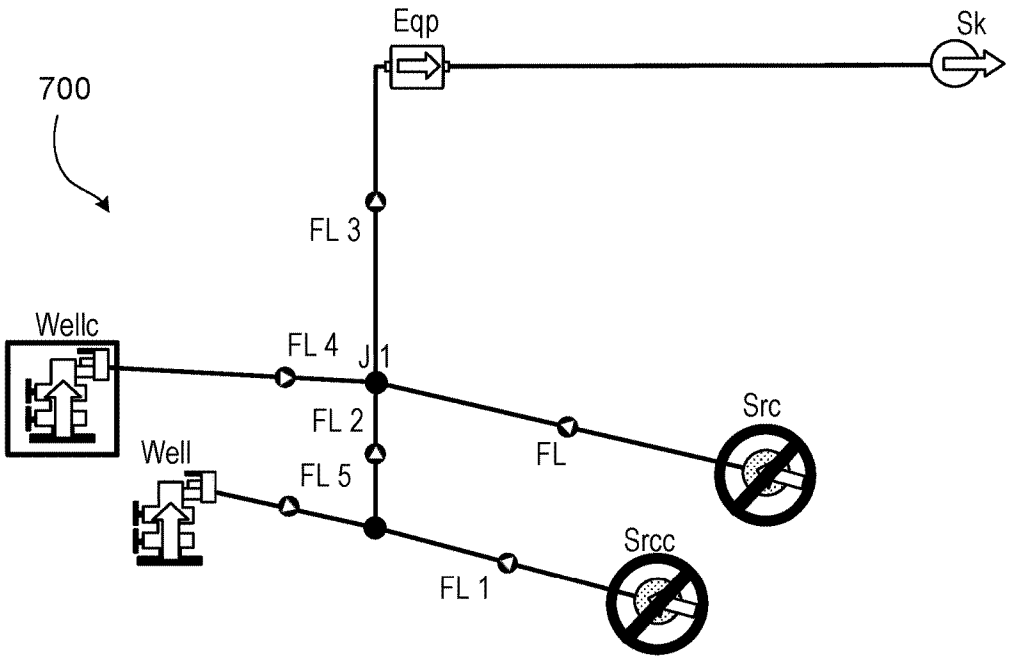
Figure 10:
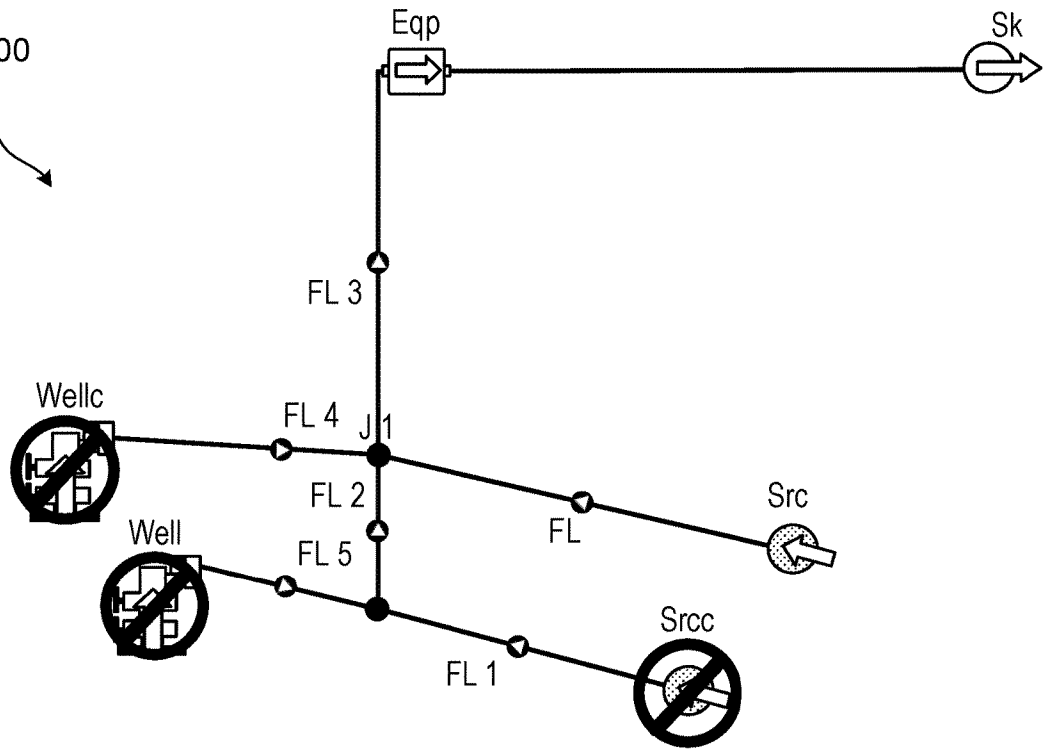
Figure 11:
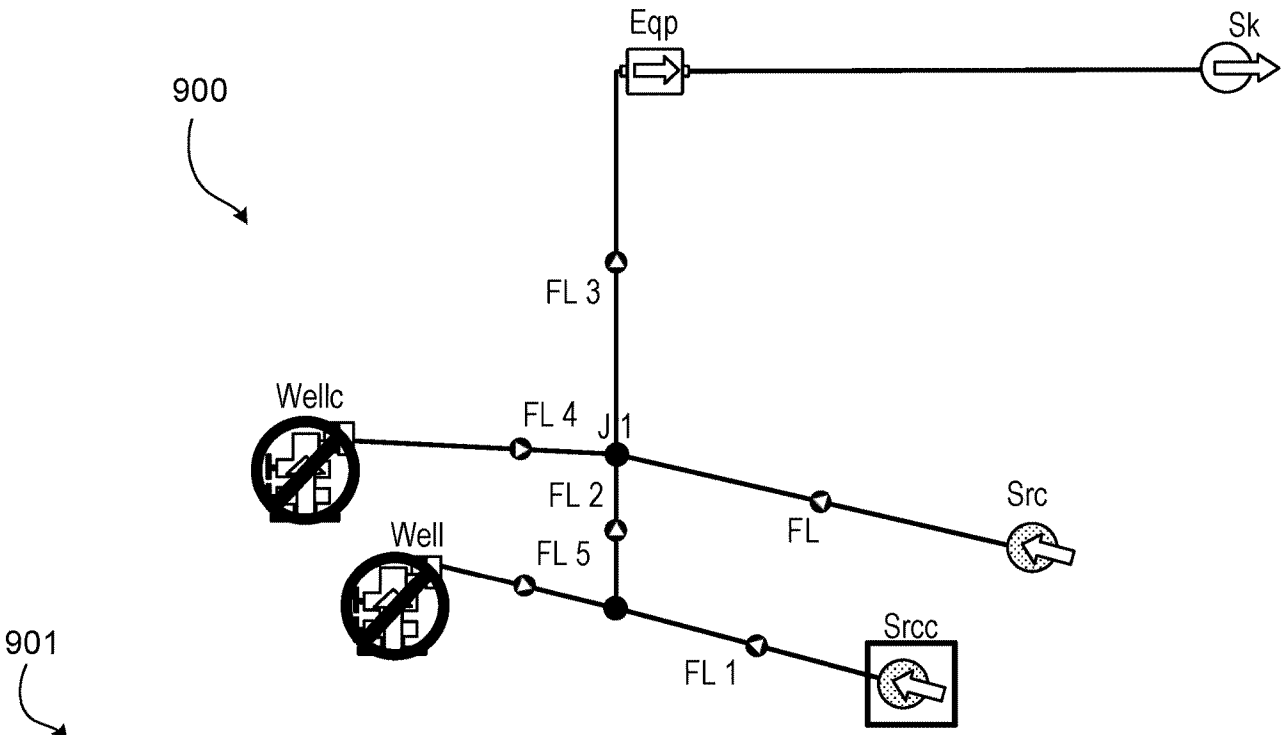

FIG. 8 provides a simulation model 600 and a table 601 of results when only one probe is simulated and is assigned a PI such that the liquid rate is 21.8 STB/d. FIG. 9 provides a simulation model 700 and a table 701 of results when both probes are open simultaneously such that each probe contributes and the total flow rate received by the pump is a summation of the individual pump flowrates. Both probes were assigned similar PIs ranging from 2 to 5. FIG. 10 illustrates a simulation model 800 and a table 801 of results that provides the flowrate when flowing one probe, when PIs are not used, and when the drawdown pressure is an assumed value. FIG. 11 provides a simulation model 900 and a table 901 of results when two probes are flowed. The results indicate that the limit of either the pump or the flowlines has been reached and therefore that the model 900 could not obtain the total flowrate of 164.

While the above-discussed sampling tools 100, 200 have been described and illustrated as including certain sizes, arrangements, and configurations, in some embodiments, sampling tools that are substantially similar in construction and function to the sampling tools 100, 200 may include one or more different sizes, arrangements, or configurations, while still being substantially suitable for carrying out the method 300.

For example, while the sampling tools 100, 200 are described and illustrated as respectively including four probes 104 and seven probes 204, in some embodiments, sampling tools that are otherwise substantially similar in construction and function to the sampling tools 100, 200 may include a different number of probes, while being suitable to carry out the method 300.

While the sampling tool 200 is described and illustrated with respect to two different mobilities, in some embodiments, a sampling tool that is substantially similar in construction and function to the sampling tool 200 may include a different variety of probes to carry out the method 300 for obtaining clean formation fluid from more than two different mobility points.

Other embodiments and implementations are also within the scope of the following claims.

What is claimed is:

1. A method of removing fluid from a rock formation using a sampling tool, the method comprising:

deploying a first probe of the sampling tool to a first axial position along a wellbore within the rock formation for sampling a first region of the rock formation and deploying a second probe of the sampling tool to a second axial position along the wellbore that is downhole of the first axial position for sampling a second region of the rock formation that is located downhole of the first region, wherein the first and second probes are arranged along a common flow line of the sampling tool;

operating a pump of the sampling tool that is positioned on the common flow line and uphole of the first probe to simultaneously withdraw fluid from the rock formation through the first and second probes during a first period of time into the common flow line to produce a fluid mixture;

determining, at an analyzer of the sampling tool that is positioned on the common flow line and uphole of the pump, that the fluid mixture is substantially clean based on a volume of drilling fluid accounting for no more than about 10% of a total volume of the fluid mixture and without determining a level of contamination in the fluid withdrawn through each of the first and second probes individually;

after the first period of time during which the fluid mixture is analyzed, disabling the second probe to prevent fluid from being withdrawn from the rock formation through the second probe and into the common flow line;

while the second probe is disabled, withdrawing fluid from the rock formation through the first probe during a second period of time to sample the first region of the rock formation, wherein the second period of time ends upon the analyzer determining that the fluid withdrawn through the first probe is substantially clean while the second probe remains disabled;

after the second period of time, disabling the first probe to prevent fluid from being withdrawn from the rock formation through the first probe and into the common flow line; and while the first probe is disabled, withdrawing fluid from the rock formation through the second probe during a third period of time to sample the second region of the rock formation that is located downhole of the first region, wherein the third period of time ends upon the analyzer determining that the fluid withdrawn through the second probe is substantially clean while the first probe remains disabled, wherein each of the second and third periods of time is shorter than the first period of time.

2. The method of claim 1, wherein simultaneously withdrawing fluid from the rock formation through the first and second probes comprises removing contamination from the rock formation.

3. The method of claim 2, wherein the first period of time is a predetermined period of time at which a majority of the contamination has been removed from the rock formation through the first and second probes.

4. The method of claim 1, further comprising collecting a sample of the fluid in a receptacle of the sampling tool that is arranged along the common flow line and positioned uphole of the analyzer.

5. The method of claim 4, wherein the common flow line comprises a single flow line along which the second probe, the first probe, the pump, the analyzer, and the receptacle are provided in a serial arrangement.

6. The method of claim 1, wherein the first axial position corresponds to a first depth along the wellbore, and the second axial position corresponds to a second depth along the wellbore that is different from the first depth.

7. The method of claim 1, wherein a first mobility of the fluid withdrawn from the rock formation through the first probe is equal to a second mobility of the fluid withdrawn from the rock formation through the second probe.

8. The method of claim 7, wherein the first probe and the second probe are of the same size.

9. The method of claim 1, wherein a first mobility of the fluid withdrawn from the rock formation through the first probe is greater than a second mobility of the fluid withdrawn from the rock formation through the second probe.

10. The method of claim 9, wherein a first size of the first probe is greater than a second size of the second probe.

11. The method of claim 10, further comprising restricting a first flowrate of fluid flowing through the first probe while fluid is simultaneously withdrawn from the rock formation through the first and second probes.

12. The method of claim 11, further comprising actuating a choke valve of the sampling tool.

13. The method of claim 9, wherein simultaneously withdrawing fluid from the rock formation through the first and second probes comprises:

simultaneously removing contamination from the rock formation through the first and second probes; and withdrawing first and second clean portions of fluid from the rock formation respectively through the first and second probes at about the same time.

14. The method of claim 1, wherein simultaneously withdrawing fluid from the rock formation through the first and second probes includes simultaneously removing contamination from the rock formation through the first and second probes and withdrawing first and second clean portions of fluid from the rock formation respectively through the first and second probes at about the same time.

15. The method of claim 1, further comprising:

deploying one or more additional probes of the sampling tool respectively to one or more additional positions along the wellbore;

withdrawing fluid through the rock formation respectively through the one or more additional probes during the first period of time;

disabling the one or more additional probes when the second probe is disabled; and serially withdrawing fluid from the rock formation through the one or more additional probes respectively during one or more additional periods of time after the third period of time has passed.

16. The method of claim 1, wherein disabling the first and second probes comprises one or both of retracting the first and second probes within a frame of the sampling tool and closing the first and second probes while the first and second probes remain in contact with the rock formation.

17. The method of claim 1, wherein the first period of time is about 4 h to about 20 h, and wherein each of the second and third periods of time is about 0.5 h to about 1 h.

18. A sampling tool, comprising:

a first probe positioned along a common flow line of the sampling tool;

a second probe positioned along the common flow line and downhole of the first probe;

a pump positioned on the common flow line uphole of the first probe and in fluid communication with the first and second probes;

an analyzer positioned along the common flow line uphole of the pump and in fluid communication with the first and second probes; and a control unit programmed to control the first and second probes and the pump to carry out a method of removing fluid from a rock formation, the method comprising:

deploying the first probe to a first axial position along a wellbore within the rock formation for sampling a first region of the rock formation and deploying the second probe to a second axial position along the wellbore that is downhole of the first position for sampling a second region of the rock formation that is located downhole of the first region;

operating the pump to simultaneously withdraw fluid from the rock formation through the first and second probes during a first period of time into the common flow line to produce a fluid mixture;

determining, at the analyzer, that the fluid mixture is substantially clean based on a volume of drilling fluid accounting for no more than about 10% of a total volume of the fluid mixture and without determining a level of contamination in the fluid withdrawn through each of the first and second probes individually;

after the first period of time during which the fluid mixture is analyzed, disabling the second probe to prevent fluid from being withdrawn from the rock formation through the second probe and into the common flow line;

while the second probe is disabled, operating the pump to withdraw fluid from the rock formation through the first probe during a second period of time to sample the first region of the rock formation, wherein the second period of time ends upon the analyzer determining that the fluid withdrawn through the first probe is substantially clean while the second probe remains disabled;

after the second period of time, disabling the first probe to prevent fluid from being withdrawn from the rock formation through the first probe and into the common flow line; and while the first probe is disabled, operating the pump to withdraw fluid from the rock formation through the second probe during a third period of time to sample the second region of the rock formation that is located downhole of the first region, wherein the third period of time ends upon the analyzer determining that the fluid withdrawn through the second probe is substantially clean while the first probe remains disabled, wherein each of the second and third periods of time is shorter than the first period of time.

* * * * *